US006836065B2

(12) United States Patent
Chow

(10) Patent No.: US 6,836,065 B2
(45) Date of Patent: Dec. 28, 2004

(54) FLUORESCENT LAMP WITH UNCOATED REGION OF FLUORESCENT MATERIL

(75) Inventor: Shing Cheung Chow, New Territories (HK)

(73) Assignee: Lap Lee Chow, Tsuen Wan (HK)

( * ) Notice: Subject to any disclaimer, the term of this patent is extended or adjusted under 35 U.S.C. 154(b) by 0 days.

(21) Appl. No.: 10/331,675

(22) Filed: Dec. 27, 2002

(65) Prior Publication Data

US 2004/0124757 A1 Jul. 1, 2004

(51) Int. Cl.[7] ..... H01J 1/62; H01J 63/04

(52) U.S. Cl. ..... 313/485; 313/493; 313/634; 313/637; 362/287; 362/565

(58) Field of Search ..... 313/485, 491, 313/493, 634, 637; 315/337, 339; 362/287, 565, 577

(56) References Cited

U.S. PATENT DOCUMENTS 2,041,909 A * 5/1936 Emmert et al. ..... 40/427
3,886,396 A * 5/1975 Hammer et al. ..... 313/486
5,219,217 A * 6/1993 Aikens ..... 362/560
5,420,481 A * 5/1995 McCanney ..... 315/291
5,552,664 A * 9/1996 Csoknyai et al. ..... 313/488
5,557,112 A 9/1996 Csoknyai et al. ..... 250/504 R
5,565,685 A 10/1996 Czako et al. ..... 250/504 R
6,107,757 A * 8/2000 Kominami et al. ..... 315/350
6,280,053 B1 * 8/2001 Chien ..... 362/228

* cited by examiner

*Primary Examiner*—Joseph Williams
*Assistant Examiner*—Kevin Quarterman
(74) *Attorney, Agent, or Firm*—Kaplan & Gilman, LLP

(57) ABSTRACT

The invention relates to a fluorescent lamp having a transparent or translucent glass bulb of a tubular cross section containing an inert gas such as Neon, Argon, Krypton or Xenon. An element to produce an electric discharge within the bulb will energize a coating of a fluorescent material deposited on the interior surface of the glass bulb to emit visible light. At least one region uncoated by the fluorescent material is provided at the interior surface of the glass bulb in manner which creates the appearance of a repeating pattern such that visible light is emitted by the fluorescent material and no visible light is emitted by the at least one region uncoated. The region uncoated define a spiraled pattern to the glass bulb such that when the glass bulb is rotated about the axis of the spiraled pattern a generally upwardly or downwardly motion is perceived by a person looking at the lamp.

27 Claims, 4 Drawing Sheets

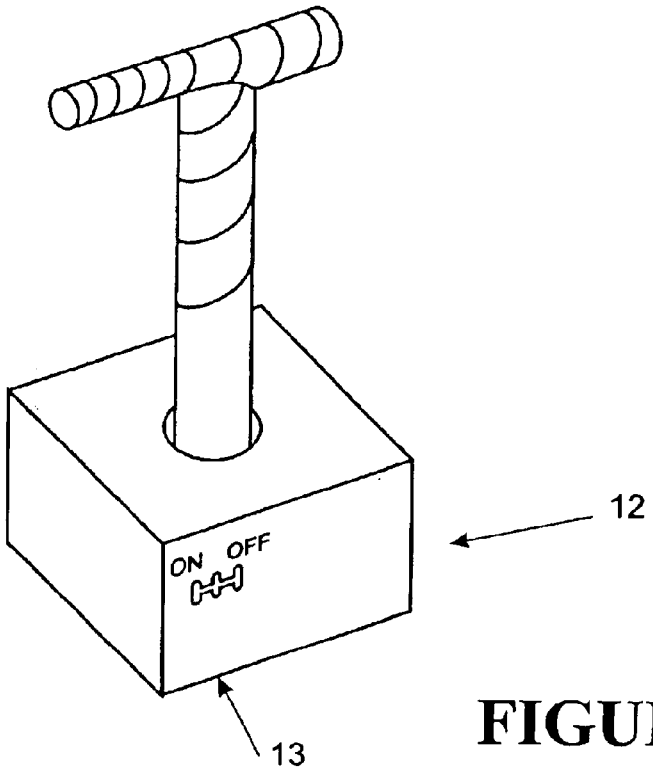
FIGURE 8
FIGURE 9A
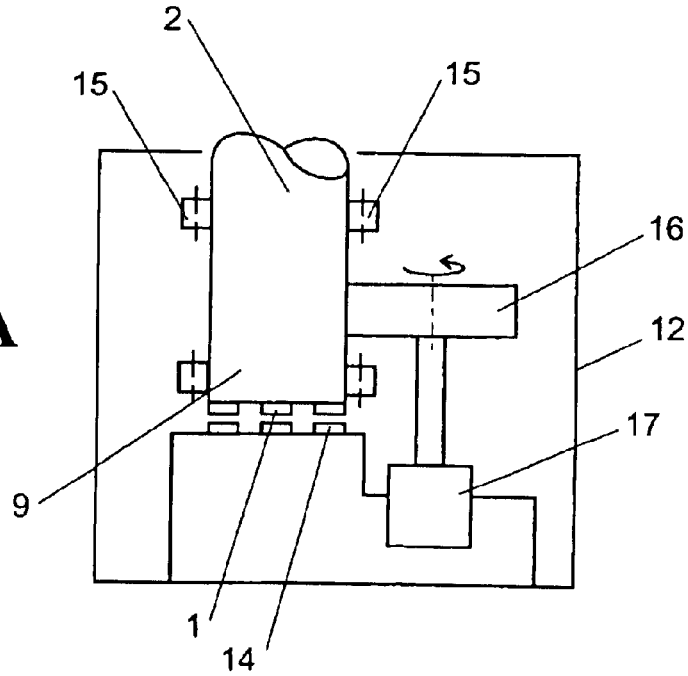

FIGURE 9B
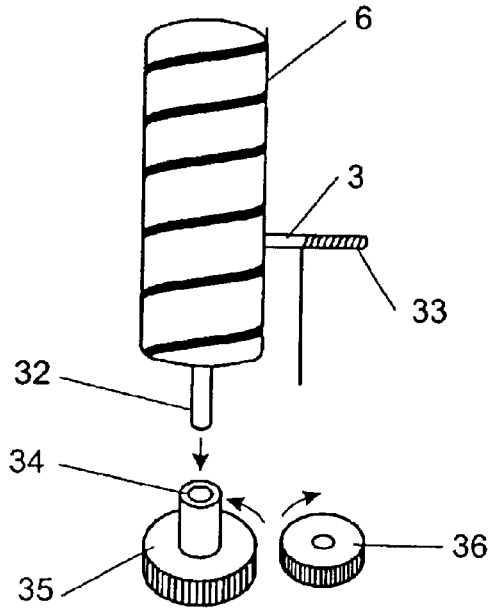
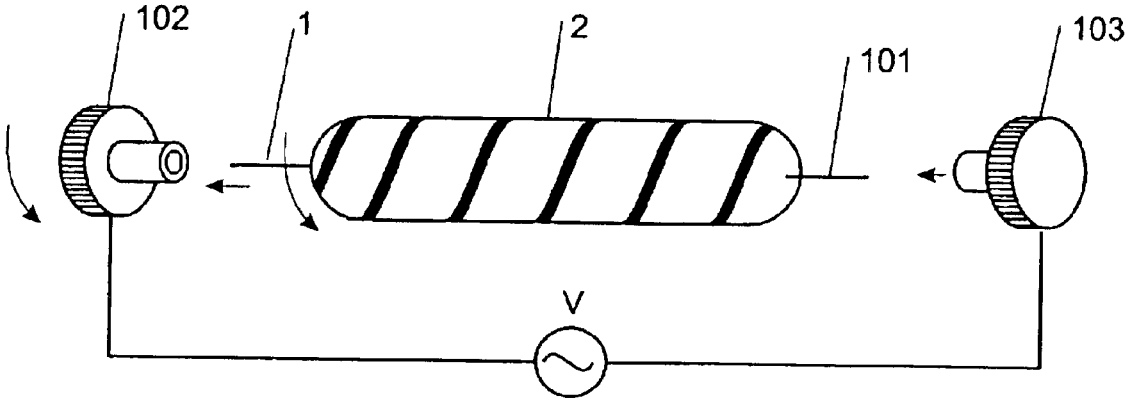
FIGURE 9C

FLUORESCENT LAMP WITH UNCOATED REGION OF FLUORESCENT MATERIL

FIELD OF INVENTION

The present invention relates to a fluorescent lamp and related mounting which, for example, but not exclusively, allows for the use of the invention in hand held applications such as, for example, at concerts or festive occasions.

BACKGROUND

Fluorescent lamps have been in use for many years primarily to provide light in dwellings and the like. Fluorescent lamps comprise a tubular bulb with a fluorescent material coated on the interior surface. The bulb typically contains an inert gas such as Neon, Argon, Krypton or Xenon and electrodes. When the electrodes are energized, a flow of electric current passes through the inert gas. During the discharge, the inert gas emits several wavelengths of light including ultraviolet light. The ultraviolet light strikes and excites the fluorescent material coating within the tube. The fluorescent material coating, when excited, emits a particular colour of visible light according to the fluorescent material chosen. Sometimes a small amount of mercury is added to the lamp in order to generate more intense ultraviolet light and hence to increase the intensity of the light emitted from the fluorescent material coating.

Standard fluorescent tubes which are used in the lighting of commercial or domestic premises consist of a tube where the fluorescent material coating is applied substantially over the entire length of the tube. The fluorescent material chosen normally emits a white or off white colour so that such a tube can efficiently illuminate a room. The light emitted is visible light. Such fluorescent tubes are purely functional and do not provide a visually appealing effect other than to illuminate a room. Fluorescent lighting tubes are produced to maximise the light that is emitted from them and hence having openings within the fluorescent material coating is generally not desirable. Furthermore since the light is of a bright intensity, fluorescent tubes used for domestic or commercial lighting purposes would hence not easily lend themselves to providing a novel visually appealing effect by the pattern application of the fluorescent material. The white and hence bright intensity of light emitted from such tubes would be too strong for a person to be able to distinguish and observe any patterned configuration of light emission. They are also not able to be used in handheld applications.

Fluorescent lamps such as those described in U.S. Pat. No. 5,565,685 and U.S. Pat. No. 5,557,112 have a tube which has a fluorescent material coating coated only in certain parts of the tube. In U.S. Pat. No. 5,557,112 for example, different zones are coated with a material so that a different radiation characteristic can be provided along the length of the tube. The tubes described in these two US patents have applications other than those for providing visible light to be viewed by a person or to appeal to the eyes of a person. The tubes described in these two US patent specifications emit an ultra violet light which is not visible to the naked eye hence a person would not be able to utilise the fluorescent tubes of U.S. Pat. No. 5,565,685 and U.S. Pat. No. 5,557,112 for the purposes of achieving a novelty effect.

Accordingly it is an object of the present invention to provide a fluorescent lamp and related mounting which can create a visible novelty and appealing effect or which will at least provide the public with a useful choice.

SUMMARY OF THE INVENTION

A first embodiment of the present invention includes in a fluorescent lamp comprising:

(a) a transparent or translucent glass bulb of a tubular cross section containing an inert gas such as Neon, Argon, Krypton or Xenon;

(b) a means to produce an electric discharge within said bulb; and (c) a coating of a fluorescent material deposited on the interior surface of said glass bulb to emit visible light upon energizations of said means to produce electric discharge;

wherein at least one region uncoated by said fluorescent material is provided at said interior surface of said glass bulb in a manner that creates the appearance of a repeating pattern where, when said means to produce electric discharge is energized, visible light is emitted by said fluorescent material and no visible light is emitted by said at least one region uncoated.

Preferably regions of the interior surface of said bulb where said coating is present will emit upon energizations, a visible light and said at least one region uncoated of the interior surface of said bulb will emit no light, but will allow light to pass there through.

Preferably said glass bulb is elongate and has a first distal end which includes a region for mounting said glass bulb with a means to mount.

Preferably said region for mounting includes a driving region at which a means to drive said means to mount is able to engage and to rotationally drive said glass bulb.

Preferably said driving region is cylindrical in shape and coaxial with the circular cross section of the first distal end of said glass tube.

Preferably at least one region is uncoated and extends longitudinally along the elongate direction of said glass bulb.

Preferably said at least one uncoated region is provided intermediate of said first and a second distal end.

Preferably said at least one uncoated region is provided extending between said first and a second distal end.

Preferably said glass tube is of a substantially constant circular cross section.

Preferably said at least one uncoated region is of a longitudinal and spiraling nature.

Preferably said at least one uncoated region is of a width (transverse to the longitudinal direction) less than half the interior circumference of said glass bulb.

Preferably there are a plurality of said uncoated regions each extending longitudinally and parallel to each other.

Preferably said plurality of said uncoated regions are in total width (transverse to the longitudinal direction) less than half the interior circumference of said glass bulb.

Preferably said means to produce a discharge is a pair of electrodes.

Preferably a first of said pair of electrodes is provided at the first distal ends of said glass bulb and a second of said electrodes is a film applied onto the exterior of said glass bulb and is energized via a lead engaged to said film proximate to said first distal end.

Preferably a second distal end of said bulb is a free end.

Preferably said pair of electrodes are provided at opposite ends of said glass bulb and both said ends of said glass bulb are supported by a means to mount.

Preferably said glass bulb is of an elongate nature and extends at least in part linearly from its first end.

Preferably said glass bulb is of an elongate nature and extends substantially linearly from its first end save for a curved region thereof at said second distal end.

Preferably said second distal end has engaged thereto a non tubular section.

Preferably said non tubular section is bulbous.

Preferably said second distal end is of a curved but tubular nature and defines a loop shaped end to said glass bulb.

Preferably said glass bulb is straight.

Preferably said regions uncoated defines a spiraled pattern to said glass bulb which when said glass bulb is rotated about the axis of said spiraled pattern a generally upwardly or downwardly motion is perceived by a person looking at said lamp.

In a second aspect the present invention consists in a lighting fixture for providing a novelty lighting effect said lighting fixture comprising a fluorescent lamp as herein before described, and a means to mount, said means to mount including a receiving region with which said fluorescent lamp is snugly engaged by or at its first distal end thereof, said receiving region rotatable by a means to rotate to rotate said lamp about an axis coaxial with the longitudinal direction of said lamp.

Preferably said means to mount is a handheld portable device which includes said means to energize.

Preferably said means to mount includes a brush remaining stationary with the housing of said means to mount and enagagble against the film defining said second electrode and via which energization of film can occur.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

FIG. 8 shows an example of tube mounted with a mounting, FIG. 9A is an interior view of an example of a mounting wherein a first end of the fluorescent tube is engaged with the mounting and wherein a means to rotate is provided to allow for the fluorescent lamp to rotate relative to the mounting, FIG. 9B is an exploded perspective view of an example of a rotation mechanism wherein a brush-like contact is provided to the transparent conducting film coating provided on the exterior of the bulb.

FIG. 9C is an alternative arrangement for imparting rotary motion.

DETAILED DESCRIPTION OF THE INVENTION

Figure 1A:
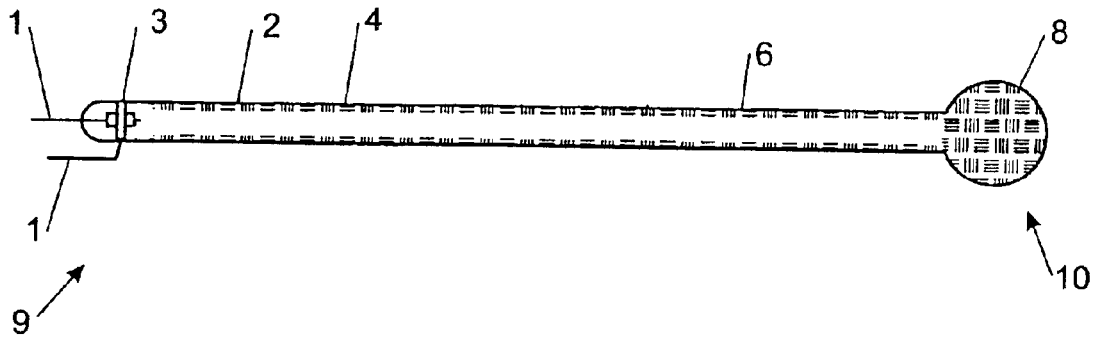
FIG. 1A is a side view of a fluorescent lamp of the present invention without any patterned fluorescent material shown.
Figure 1B:
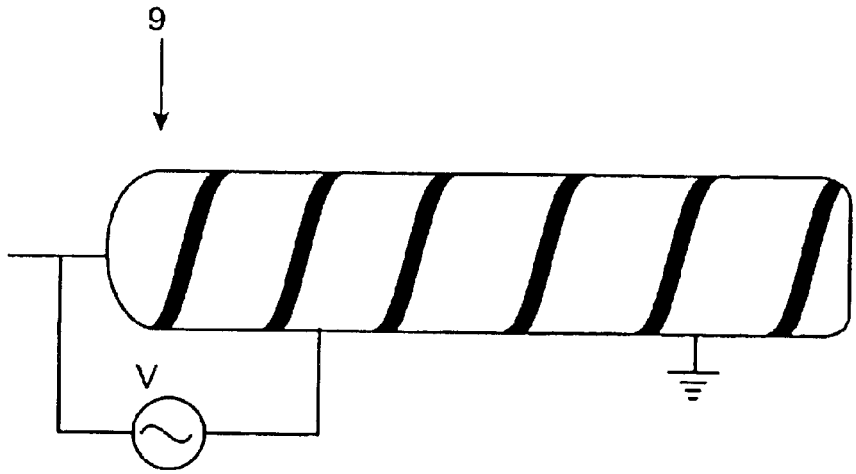
FIG. 1B is a view of a fluorescent lamp of the present invention to illustrate the manner in which energization of the gases within the tube can occur by the provision of electrodes located at or proximate to one end only of the lamp.

The present invention comprises a fluorescent lamp as for example shown in FIG. 1A. The fluorescent lamp includes a tube 2 preferably made of glass and which is preferably of a cylindrical shape and substantially of constant cross section. The tube 2 may have at one of its ends a non-constant cross section extension such as for example the bulbous extension 8 as shown in FIG. 1A or other shape as shown in FIG. 8. Such an extension may be of glass and blown as part of the same material as the glass tube 2, or it may have been engaged to the glass tube 2 after the glass tube 2 has been formed. The glass tube 2 is sealed to the exterior and contains an inert gas such as, for example, Neon, Argon, Krypton or Xenon. Mercury can optionally be added to increase the amount of ultraviolet light if desired; however mercury is not necessary for this invention to work. The glass tube 2 has a first end 9 where at least one and preferably both electrode terminals 1 are provided. The electrode terminals 1 are provided in a manner so that these can be engaged to a power source such as one derived from a battery. The terminals 1 are preferably provided at or proximate to the first end 9 however one of the terminals may alternatively be provided at the second end 10 of the tube. The preferred form is shown in FIG. 1B where two electrode terminals are close to end 9.

The configuration of the electrodes for discharging the inert gas can be both provided from the first end 9 and reference is hereby made to U.S. Pat. No. 4,471,350. The contents of U.S. Pat. No. 4,471,350 describes a fluorescent tube of a kind which may be utilised for the purposes of the present invention. The entire contents of U.S. Pat. No. 4,471,350 is hereby incorporated by way of reference. Item 6 on FIG. 1A is directed towards the conductive film provided on the exterior of the tube. Conductor 3 connects this conductive film to the power source through one of the terminals 1. The steps involved in applying a conductive film to the exterior of the glass tube are as follows: (1) Heat the glass tube; (2) Spray $SnCl_4$ (tin (IV) chloride) onto the exterior surface of the glass tube. $SnCl_4$ will react with $O_2$ (Oxygen) in the air to produce $SnO_2$ (tin dioxide) and $Cl_2$ (chlorine). $SnO_2$ is the conductive material (in solid form) which will stick on the exterior surface of the glass tube firmly to become a conductive film.

Figure 2:
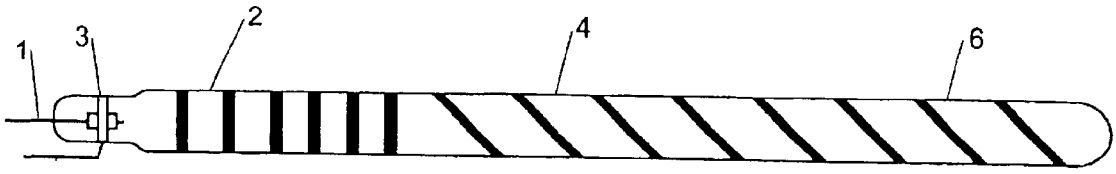
FIG. 2 is a side view of a fluorescent lamp wherein two different styles of patterns have been formed by the provision of openings in the fluorescent material layer coated on the interior surface of the tube.
Figure 3:
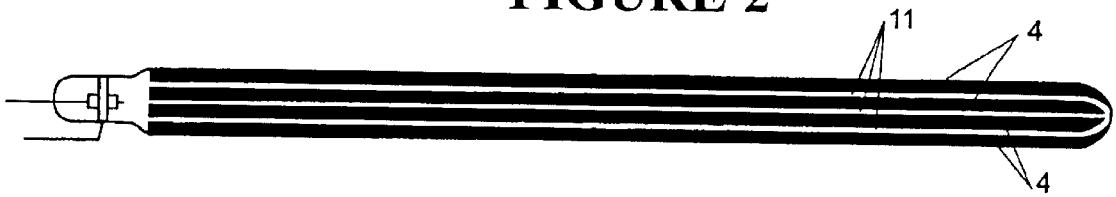
FIGS. 3-6 show alternative patterns of the fluorescent material.

The interior of the glass tube 2 is coated with a fluorescent material 4. The fluorescent material coating is preferably chosen such that it emits a colour other than white. To provide a novel viewing effect, the fluorescent material is preferably selected from those which emit vibrant colour. At least part of the interior of the glass tube 2 is coated with the fluorescent material. However there are also provided openings in the fluorescent material coating. The openings (which may alternatively be considered uncoated regions) create transparent regions in the glass tube and allows for the interior of the glass tube to be visible from the exterior. The interior of the lamp bounded by the glass tube is exposed to the exterior everywhere save for where the fluorescent material is applied to the interior of the tube. With reference to FIG. 3, it can be seen that the fluorescent material 4 is applied save for at the openings 11. The multiple openings 11 shown in FIG. 3 extend substantially parallel and longitudinally along the interior surface of the glass tube. Although there may only be provided one opening, a plurality of openings have shown to be provided in at least FIGS. 3, 4 and 5. When the electrodes are energized, and internal inert gas of the glass tube discharges to emit ultraviolet light, the fluorescent material 4 will be excited to emit visible light of a certain colour. At the openings, the visible light emitted through the glass tube will be from the fluorescent material coating on the far side interior surface of the tube. As can be seen in FIGS. 1-6, the glass tube is preferably of an elongate nature and substantially of a constant cross-sectional shape.

Figure 4:
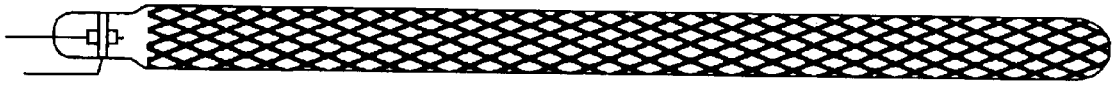
Figure 6:
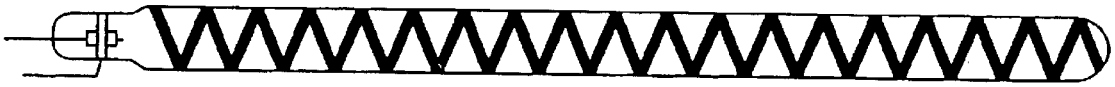

With reference to FIGS. 3, 4 and 6, the opening(s) are longitudinal in nature and extend in the longitudinal direction. With reference to FIGS. 4 and 6, the opening(s) may also have a component of direction which is tangential.

FIGS. 4 and 6 illustrate a spiralling pattern that is generated by the provision of the opening.

FIG. 6 illustrates a glass tube wherein a single opening has been provided which runs the entire length and spirals the entire length of the glass tube.

In FIG. 4, multiple openings are provided which spiral the length of the tube to provide a similar but more dense spiralled effect.

Figure 5:
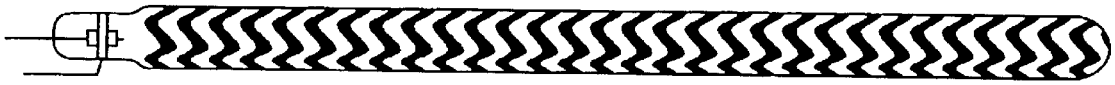

The openings in FIG. 5 do not extend longitudinally but instead define discrete rings which are, for example, of a wave like shape. In fact any desired patterned effect can be created.

The openings may be created by the scraping away of fluorescent material which has been coated to the interior surface of the glass tube. Such scraping can occur whilst at least one of the ends of the glass tube is open. A tool can be inserted into the glass tube and the tool can be moved relative to the glass tube to scrape away the fluorescent material to create the opening(s). Alternatively the fluorescent material may be pattern applied by for example the use of a mask.

The opening or openings provided in the fluorescent material coating create a patterned appearance of the fluorescent material coating. The patterned appearance is preferably of a repeating kind. With reference to FIG. 2, the openings through the fluorescent material coating may create more than one kind of pattern. It is also possible that regions of different coloured fluorescent material coating are provided to the interior surface of the tube. Such may be provided by connecting two tubes together which have each been individually coated with a different coloured fluorescent material coating. The openings in such a multi coloured configuration may have been created by removing the fluorescent material coating prior to the tubes being connected together or after the tubes having been connected together.

Figure 7:
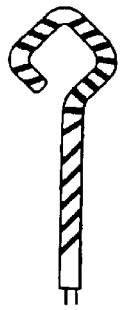
FIG. 7 illustrates a fluorescent lamp where the second end has been formed to provide a tube which is partially straight and partially curved.

The lamp may have a second end 10 which has a shape which deviates from the straight tubular nature as shown in FIGS. 2-6. For example, with reference to FIG. 7, the second distal end 10 has been curved and such a curve can in an abstract sense be made to simulate the flame of a candle for example. This is shown in FIG. 7. It will hence be appreciated that the fluorescent lamp of the present invention can be used to provide a novelty product of many shapes and any patterned fluorescent material coating appealing to the eye.

With provision of the openings in the fluorescent material coating, when the tube is moved, the light which is emitted will further create a novelty viewing experience. The regions of the tube where fluorescent material is provided, will emit "foreground" visible light, i.e., visible light emitted from the near side fluorescent material coating and the regions where the openings are provided will emit "background" visible light, i.e., visible light emitted from the fluorescent material coating provided on the far side of the interior surface of the glass tube. Light from the fluorescent material coating on the opposite side of the tube to where an opening is provided, can be transmitted through the opening. The light from the fluorescent material coating on the opposite side of the tube to where an opening is provided, will pass through the opening and have a different quality or brightness from the light which is transmitted from the fluorescent material coating adjacent the opening and on the same side of the opening of the tube. A 3-D viewing effect will thus be experienced by a viewer.

The fluorescent lamp of the present invention may be mounted to a mounting 12 as shown in FIG. 8. Mounting for the lamp may occur at only one of its ends. The first end 9 may for example be inserted into a receiving region of the mounting 12. The mounting 12 may include an appropriate connection to a power source such as a battery so that energization of the electrodes and discharge of the inert gas within the tube can occur. The mounting may hence be self contained and may also include an on and off switch 13. The fluorescent lamp may be mounted with the mounting 12 in a manner to be removable therefrom. In the form where the lamp is mounted from one end only, the lamp includes an electrode 32 which extends into the interior of the lamp and a transparent conducting film coated on the exterior surface of the tube. With reference to FIG. 9B, a brush-like conductor 3 is in contact with the exterior surface of the tube thereby providing a conducting path for the electricity conducted via the transparent conducting film. The conductor 3 may remain stationary whilst the tube rotates and a spring 33 may be provided to bias the conductor 3 against the exterior surface of the tube. The electrode 32 can insert into an opening 34 of a driving gear 35 wherein the driving gear itself can be made of a conducting material. A second gear 36 may provide the insulation required to isolate the flow of electricity from the gear 35.

In an alternative configuration as shown in FIG. 9C, the lamp is mounted at two ends. The lamp includes a first electrode 1 and a second electrode 101 at the respective ends of the tube 2 each extending into the interior of the lamp. Each of the two electrodes inserts into an opening of a gear. The electrodes are connected to a power source through an appropriate connection such as through the gears to which they are connected which can be made of a conducting material. A driving gear 102 rotates the tube through the coupling of the gear with the first electrode 1. The other gear 103 rotates in concert with the driving gear 102 through a gear system which is not shown in FIG. 9C but can be one commonly known in the art.

The lamp as shown in FIG. 1B is energized by an AC power source. Where DC batteries are provided there would be a DC to AC converter providing an AC voltage from approximately 200 volts to approximately 2000 volts at a frequency over 1 kHz from battery voltages of 3 volts to 6 volts DC. The exterior surface conducting film is of substantially the same voltage as the earth. The voltage at the electrode extending into the interior of the tube will vary according to the AC voltage. Because the exterior surface conducting film is substantially at earth, a person touching the exterior surface of the glass tube will not experience an electric shock. Even if the high voltage electrode is touched, the current generated will be very small and will not be hazardous to the health since the resistance of the glass is very high.

Fluorescent lamps of different configurations or colours may for example be interchanged and mounted with the mounting means. Where the fluorescent lamps are designed to be used in entertainment or concert like situations, the mounting 12 is preferably of a size sufficiently small to be carried in or by the hand of a person. Likewise the fluorescent lamp to engage with such a mounting is of a size which is not too large. The fluorescent lamp may for example be of a length of between 1 and 100 cm and of a diameter between 0.15 and 1.5 cm.

The fluorescent material is chosen such that the light emitted is within the visible range of say between 350 nm to 750 nm.

The mounting 12 and the fluorescent lamp may alternatively be of a larger size and may be designed to simulate the barber shop spiral, traditionally associated with barber shops.

The fluorescent lamp in such an application may again be mounted only at one end, or alternatively at both ends. In both the barber shop application and in the concert/festive situations, it may be desirable that the fluorescent lamp is rotated relative to the mounting 12. With reference to FIG. 9, there is shown a basic layout of the interior of a mounting 12 within which the tube 2 has been engaged at its end 9. The terminals 1 of the tube are engaged with complementary terminals 14 of the mounting 12. The tube 2 is mounted so that it is rotatable relative to the housing. Rotatable bearing surfaces 15 may for example be provided in between which the tube 2 can snugly locate and be supported thereby in a rotational manner. A means rotatable such as a drive wheel 16 which is driven by an electric motor 17 can engage with the exterior surface of the tube 2. The electric motor when it is rotated, will rotate the drive wheel 16 which through friction or through a toothed or belt drive engagement with the tube, will rotate the tube about its longitudinal axis.

What is claimed is:

1. A fluorescent lamp comprising:

(a) a transparent or translucent glass bulb of a tubular cross section containing an inert gas such as Neon, Argon, Krypton or Xenon, (b) a means to produce an electric discharge within said bulb; and (c) a coating of a fluorescent material deposited on the interior surface of said glass bulb to emit visible light upon energization of said means to produce electric discharge;

wherein at least one region uncoated by said fluorescent material is provided at said interior surface of said glass bulb in manner which creates the appearance of a repeating pattern where, when said means to produce electric discharge is energized, visible light is emitted by said fluorescent material and no visible light is emitted by said at least one region uncoated.

2. A fluorescent lamp as claimed in claim 1 wherein regions of the interior surface of said bulb where said coating is present will emit upon energizations, a visible light and said at least one region uncoated of the interior surface of said bulb will emit no light, but will allow light to pass there through.

3. A fluorescent lamp as claimed in claim 1 wherein said glass bulb is elongate and has a first distal end which includes a region for mounting said glass bulb with a means to mount.

4. A fluorescent lamp as claimed in claim 3 wherein said region for mounting includes a driving region at which a means to drive said means to mount is able to engage and to rotationally drive said glass bulb.

5. A fluorescent lamp as claimed in claim 4 wherein said driving region is cylindrical in shape and coaxial with the circular cross section of the first distal end of said glass bulb.

6. A fluorescent lamp as claimed in claim 3 wherein at least one region uncoated extend longitudinally along the elongate direction of said glass bulb.

7. A fluorescent lamp as claimed in claim 3 wherein said at least one region uncoated is provided intermediate of said first and a second distal end.

8. A fluorescent lamp as claimed in claim 3 wherein said at least one region uncoated is provided extending between said first and a second distal end.

9. A fluorescent lamp as claimed in claim 1 wherein said glass bulb is of a substantially constant circular cross section.

10. A fluorescent lamp as claimed in claim 1 wherein said at least one region uncoated is of a longitudinal and spiraling nature.

11. A fluorescent lamp as claimed in claim 10 wherein said at least one region uncoated is of a width (transverse to the longitudinal direction) less than half the interior circumference of said glass bulb.

12. A fluorescent lamp as claimed in claim 1 wherein there are a plurality of said regions uncoated each extending longitudinally and parallel to each other.

13. A fluorescent lamp as claimed in claim 12 wherein said plurality of said regions uncoated are in total width (transverse to the longitudinal direction) less than half the interior circumference of said glass bulb.

14. A fluorescent lamp as claimed in claim 1 wherein said means to produce a discharge comprises a pair of electrodes.

15. A fluorescent lamp as claimed in claim 14 wherein a first of said pair of electrodes is provided at the first distal end of said glass bulb and a second of said electrodes is a film applied onto the exterior of said glass bulb and is energized via a lead engaged to said film proximate to said first distal end.

16. A fluorescent lamp as claimed in claim 3 wherein a second distal end of said bulb is a free end.

17. A fluorescent lamp as claimed in claim 14 wherein said pair of electrodes are provided at opposite ends of said glass bulb and both said ends of said glass bulb are supported by said means to mount.

18. A fluorescent lamp as claimed in claim 3 wherein said glass bulb is elongate and extends at least in part linearly from its first end.

19. A fluorescent lamp as claimed in claim 3 wherein said glass bulb is elongate and extends substantially linearly from its first end save for a curved region thereof at a second distal end.

20. A fluorescent lamp as claimed in claim 3 wherein a second distal end has engaged thereto a non tubular section.

21. A fluorescent lamp as claimed in claim 20 wherein said non tubular section is bulbous.

22. A fluorescent lamp as claimed in claim 3 wherein a second distal end is of a curved but tubular nature and defines a loop shaped end to said glass bulb.

23. A fluorescent lamp as claimed in claim 1 wherein said glass bulb is straight.

24. A fluorescent lamp as claimed in claim 1 wherein said regions uncoated define a spiraled pattern to said glass bulb which when said glass bulb is rotated about the axis of said spiraled pattern a generally upwardly or downwardly motion is perceived by a person looking at said lamp.

25. A lighting fixture for providing a novelty lighting effect, said lighting fixture comprising a fluorescent lamp as claimed in claim 1, and a means to mount, said means to mount including a receiving region with which said fluorescent lamp is snugly engaged by or at its first distal end thereof, said receiving region rotatable by means to rotate said lamp about an axis coaxial with the longitudinal direction of said lamp.

26. A lighting fixture as claimed in claim 25 wherein said means to mount is portable and includes a handheld housing which includes a means to energize.

27. A lighting fixture as claimed in claim 26 wherein said means to mount includes a brush-like conductor remaining stationary with the housing of said means to mount and enagagble against the film defining a second electrode and via which energization of film can occur.

* * * * *